US009887500B2

(12) United States Patent
Riner

(10) Patent No.: US 9,887,500 B2
(45) Date of Patent: Feb. 6, 2018

(54) SNAP-IN ELECTRICAL RECEPTACLE

(71) Applicant: Group Dekko, Inc., Garrett, IN (US)

(72) Inventor: Raymond H. Riner, Fort Wayne, IN (US)

(73) Assignee: Group Dekko, Inc., Garrett, IN (US)

( * ) Notice: Subject to any disclaimer, the term of this patent is extended or adjusted under 35 U.S.C. 154(b) by 0 days.

(21) Appl. No.: 15/138,793

(22) Filed: Apr. 26, 2016

(65) Prior Publication Data

US 2017/0310061 A1 Oct. 26, 2017

(51) Int. Cl.
*H01R 13/73* (2006.01)
*H01R 13/74* (2006.01)
*H01R 43/00* (2006.01)

(52) U.S. Cl.
CPC ..... *H01R 13/743* (2013.01); *H01R 43/00* (2013.01)

(58) Field of Classification Search
CPC ..... H01R 13/74; H01R 13/741; H01R 13/743
USPC ..... 439/535, 536, 544, 557, 562
See application file for complete search history.

(56) References Cited

U.S. PATENT DOCUMENTS 3,384,862 A 5/1968 Shroyer
3,437,737 A 4/1969 Wagner
3,514,743 A * 5/1970 Schantz ..... H01R 13/743 439/557
4,847,444 A 7/1989 Holland
5,015,203 A * 5/1991 Furrow ..... H01R 13/743 439/535
5,658,166 A * 8/1997 Freeman ..... H01R 13/518 439/49
6,376,770 B1 4/2002 Hyde
6,943,296 B2 * 9/2005 Perrella ..... H02G 3/18 174/66
7,131,864 B2 * 11/2006 Peng ..... H01R 31/06 439/536
7,278,360 B2 10/2007 Griepentrog
7,479,031 B2 1/2009 Tiberio et al.
8,629,349 B2 1/2014 Martino et al.

* cited by examiner

*Primary Examiner* — Khiem Nguyen
(74) *Attorney, Agent, or Firm* — Taylor IP, P.C.

(57) ABSTRACT

A snap-in electrical receptacle comprising a housing including a plurality of sides, a face plate attached to the housing, at least one electrical outlet attached to the face plate, and at least one L-shaped member included in at least one of the plurality of sides, the L-shaped member including a shelf generally coplanar with the face plate and an inclined protrusion. The snap-in electrical receptacle can be installed without tools or extraneous fasteners, and may be configured with a multiple variety of electrical inlet ports and electrical outlets.

15 Claims, 3 Drawing Sheets

SNAP-IN ELECTRICAL RECEPTACLE

BACKGROUND OF THE INVENTION

1. Field of the Invention

The present invention relates to electrical power receptacles, and, more particularly, to snap-in electrical receptacles with multiple outlet possibilities.

2. Description of the Related Art

In many applications, electrical receptacles are needed to receive and distribute power. They are required in permanent locations such as walls in fixed structures, as well as temporary locations such as modular office furniture. Many types of receptacles are required according to the needs of users. Some receptacles, for example, include distribution of power for computers, telephones, and corded appliance, etc. The electrical receptacles also are required in places that are convenient for the user, and may need to be re-located.

It is known in the art to have electrical receptacles that are attached to supporting surfaces via fasteners, typically screws. It is also known in the art to permanently attach electrical receptacles to supporting surfaces. It is further known in the art to require access to the back of the receptacle in order to remove it from the supporting surface.

Depending upon the types of electrical receptacles and the applications in which they are used, various problems can be encountered. One problem is the reliance upon screws or other fasteners to secure the electrical receptacles to their respective supporting surfaces. Using fasteners makes installation and removal cumbersome and prone to failures. It also requires a mating configuration at each desired location.

Another problem that can be encountered is that very little modularity is available with current electrical receptacles; that is, they are typically limited as to their electrical input ports and electrical outlet configurations.

A further problem that can be encountered is the inability to easily install the electrical receptacle and remove it at a later time, and further to use the same receptacle in a different location.

What is needed in the art is an apparatus that can receive and distribute power and can be installed and removed easily into openings of supporting surfaces.

SUMMARY OF THE INVENTION

The present invention is directed to an improved electrical power receptacle with features that allow it to be snapped in to an opening of a supporting surface, and easily removed if desired.

The present invention provides a snap-in electrical power receptacle for providing a power inlet and outlet to desirable locations, insertable into openings in support surfaces without tools or extraneous fasteners.

The present invention further provides a snap-in electrical power receptacle with at least one elastically deformable manner that displaces while the receptacle is being inserted, and returns to its original position when the receptacle is fully seated.

The present invention further provides a snap-in electrical power receptacle variably configured with electrical outlets and electrical input ports.

An advantage of the present invention is that the snap-in electrical power receptacle can be easily installed in an and remain secured to an opening of a supporting surface, without tools or extraneous fasteners.

Another advantage of the present invention is that the snap-in electrical power receptacle can be removed from the opening in the supporting surface without the necessity of removing or loosening extraneous fasteners.

Yet another advantage of the present invention is that the snap-in electrical power receptacle can be removed from the front; that is, it can be removed without needing to access the inventive receptacle from behind the supporting surface.

Still another advantage of the present invention is that the snap-in electrical power receptacle can be configured with a variety of electrical inlet ports and electrical outlets.

Yet another advantage of the present invention is that the snap-in electrical power receptacle can be used in any supporting surface including walls, tables, ceilings, floors, raceways, columns, posts, etc.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
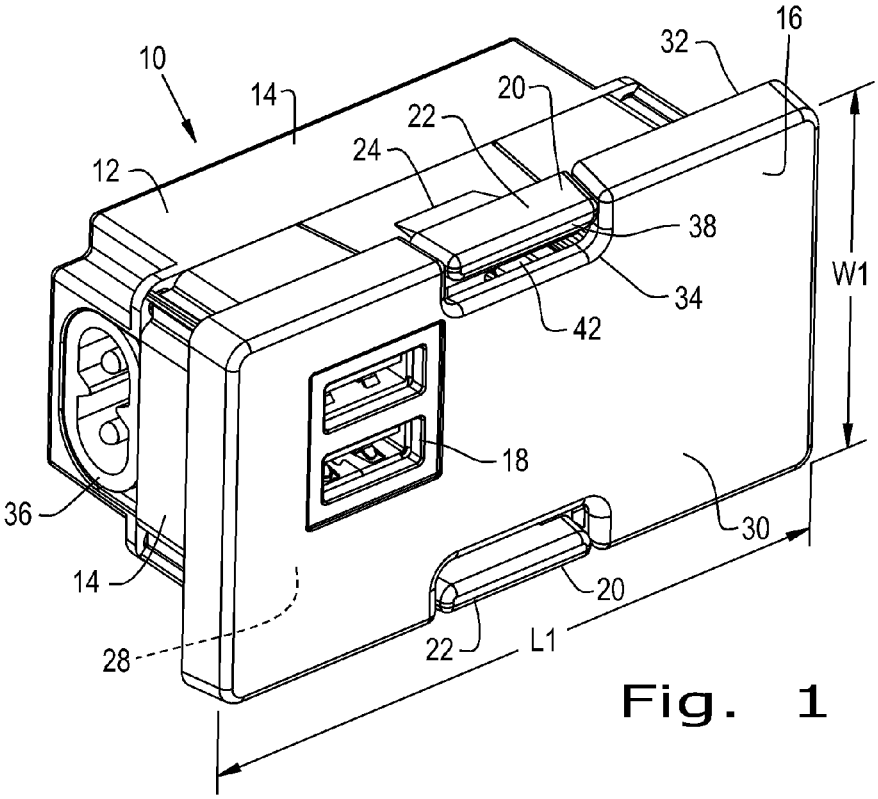
FIG. 1 is a front perspective view of an embodiment of a snap-in electrical receptacle assembly of the present invention.
Figure 2:
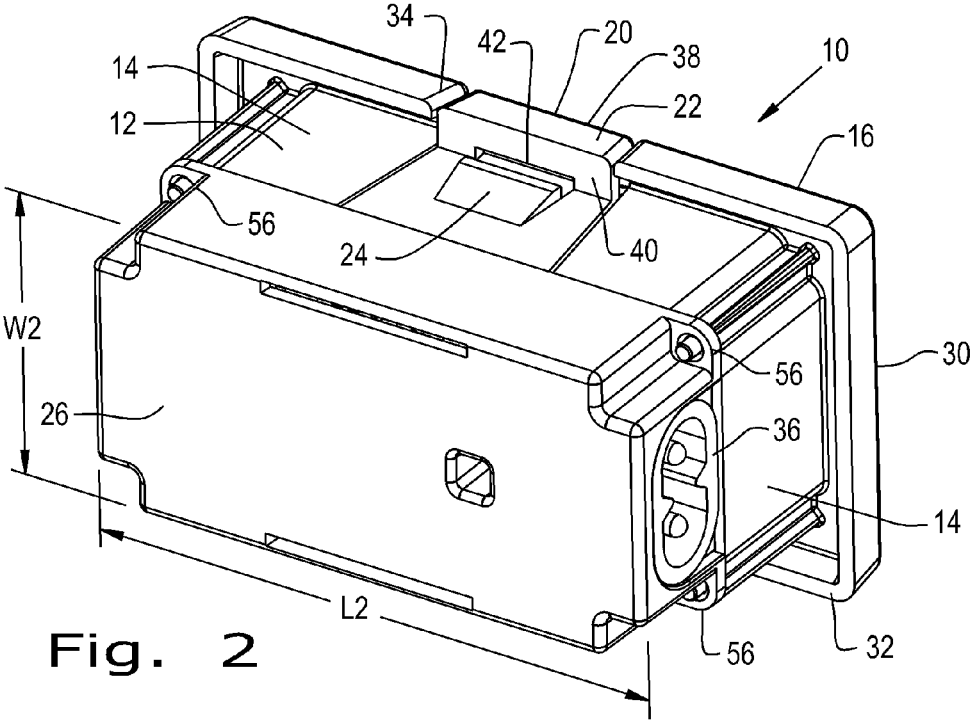
FIG. 2 is a rear perspective view of the embodiment of FIG. 1.
Figure 3:
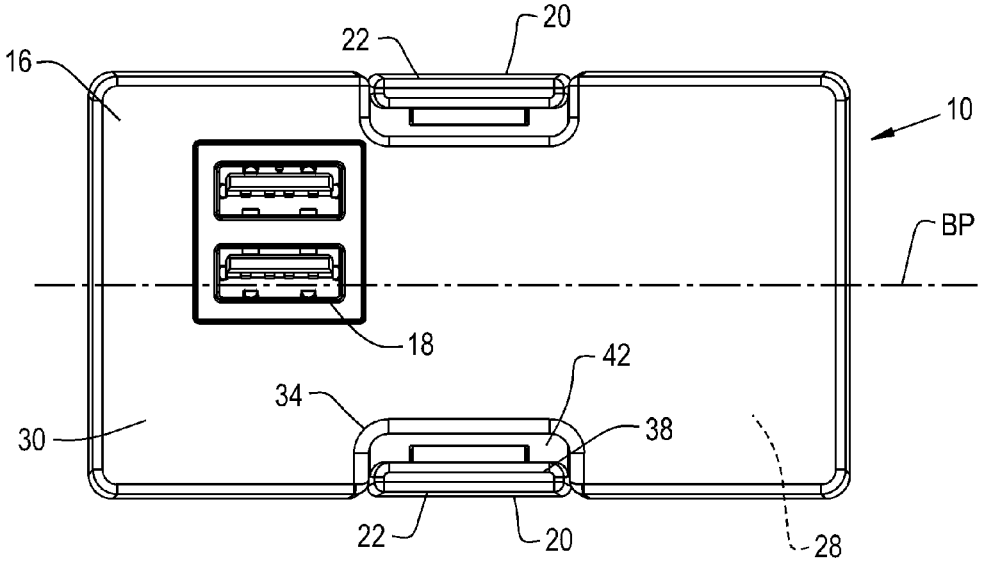
FIG. 3 is a front view of the embodiment of FIG. 1.

Referring now to FIGS. 1-3, there is shown an embodiment of a snap-in electrical receptacle assembly 10 according to the present invention. Snap-in electrical receptacle assembly 10 includes housing 12 and face plate 16.

Housing 12 of snap-in electrical receptacle assembly 10 includes a plurality of sides 14, a back 26, a front opening 28 (not illustrated), a length L2, and a width W2. Housing 12 further includes at least one electrical input port 36 on at least one of the plurality of sides 14. The at least one electrical input port 36 can be on any of the at least one of the plurality of sides 14; FIGS. 1-2 illustrate one possible configuration.

The at least one electrical input port 36 can be any type of electrical input port; although a two-wire port is shown, a three-wire port or any other electrical input port 36 may be included. Additionally, housing 12 may include one type of electrical input port 36 or a mixture of different types.

Housing 12 further includes a bisecting plane BP (see FIG. 3), which divides the housing 12 into two parts. An additional bisecting plane BP2 (not shown) may also be included, which is perpendicular to bisecting plane BP.

Housing 12 further includes at least one L-shaped member 20 on at least one of the plurality of sides 14. The at least one L-shaped member 20 can be on any of the at least one of the plurality of sides 14; FIGS. 1-2 illustrate one possible configuration.

The at least one L-shaped member 20 includes a shelf 22 with a top surface 38 and a bottom surface 40, and further includes an inclined protrusion 24. The at least one L-shaped member 20 may further include a slot 42 in the shelf 22. The purposes of the shelf 22, inclined protrusion 24, and slot 42 are described further in this specification.

The at least one L-shaped member is configured so that the shelf 22 and inclined protrusion 24 can flexibly move toward bisecting plane BP when a force is applied to it and then away from bisecting plane BP when the force is removed from it.

Face plate 16 includes a front surface 30, a back surface 32, a notch 34, a length L2, and a width W2. Face plate 16 further includes at least one electrical outlet 18 on front surface 30. The at least one electrical outlet 18 can be any type of electrical input port; although a Universal Serial Bus (USB) outlet is shown, an alternating current (AC) outlet (see FIG. 6) or any other electrical outlet 18 may be included. Additionally, face plate 16 may include one type of electrical outlet 18 or a mixture of different types.

Face plate 16 and housing 12 can be manufactured as a single unit, or face plate 16 can be attached to housing 12 with a plurality of fasteners 56, for example. When the electrical receptacle assembly 10 is assembled, the top surface 38 of shelf 22 of the at least one L-shaped member 20 is flush with the front surface 30 of face plate 16. Additionally, the shelf 22 of the at least one L-shaped member 20 fits within the notch 34 of face plate 16.

Figure 4:
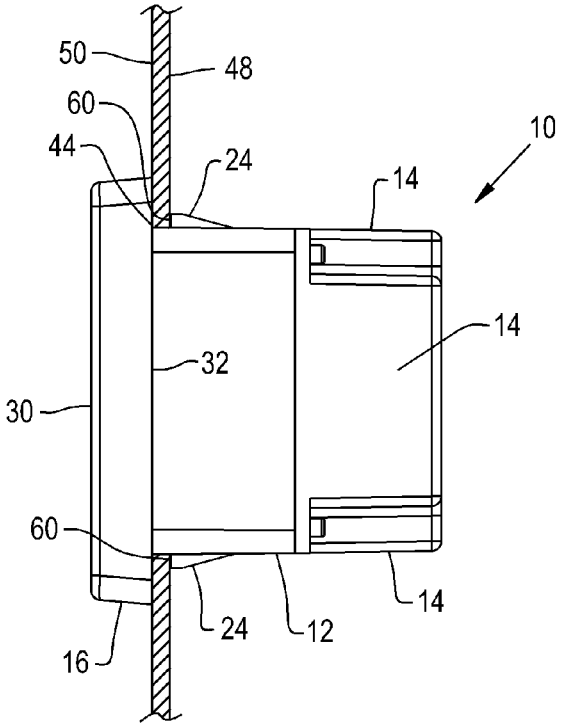
FIG. 4 is a side view of the embodiment of FIG. 1 shown placed on a mounting surface.

Now referring to FIG. 4 with continued reference to FIGS. 1-3, a method of installing the snap-in electrical receptacle assembly 10 in a supporting surface 46 is described hereby. Supporting surface 46 can be any surface such as a wall, a table, a ceiling, a floor, a raceway, a column, a post, or any other surface where an electrical receptacle is desired in a permanent or temporary location. Supporting surface 46 includes back face 48, front face 50, and opening 44.

As previously mentioned, housing 12 includes an inclined protrusion 24 on the at least one L-shaped member 20. Inclined protrusion 24 protrudes a depth P1 from one of the plurality of sides 14.

To install snap-in electrical receptacle assembly 10 in the supporting surface 46, the back 26 of housing 12 is inserted into the opening 44, which is dimensionally larger than L2 and W2 of housing 12 but dimensionally smaller than W2 of housing 12 plus P1 of inclined protrusion 24. As the housing 12 continues to be inserted into opening 44, the inclined protrusion 24 and shelf 22 are flexibly urged under elastic deformation toward bisecting plane BP. When the inclined protrusion 24 clears the back face 48 of supporting surface 46, the inclined protrusion 24 and shelf 22 are free to move back to their original position.

At this point, which is the final position of the snap-in electrical receptacle assembly 10, the top surface 60 of the inclined protrusion 24 prevents the snap-in electrical receptacle assembly 10 from being pulled from the opening 44 as a result of its contact with the back face 48 of supporting surface 46. The snap-in electrical receptacle assembly 10 is prevented from further insertion into opening 44 as a result of the back surface 32 of face plate 16 contacting the front face 50 of supporting surface 46, and the dimensions L1 and W1 being greater than the corresponding opening 44 dimensions.

To remove snap-in electrical receptacle assembly 10 in the supporting surface 46, the shelf 22 of at least one L-shaped member 20 is urged toward bisecting plane BP, which in turn displaces inclined protrusion 24 toward bisecting plane BP. This displacement allows a housing-only dimension of W2, which is smaller than the corresponding opening 44 dimension, and the snap-in electrical receptacle assembly 10 can be completely removed.

Alternatively, and as mentioned above, the at least one L-shaped member 20 can include a slot 42 in the shelf 22. The slot 42 can either be countersunk in shelf 22, or pass all the way through it. If desired, a tool may be placed in slot 22 to assist in the urging of the at least one L-shaped member 20 toward bisecting plane BP.

Figure 5:
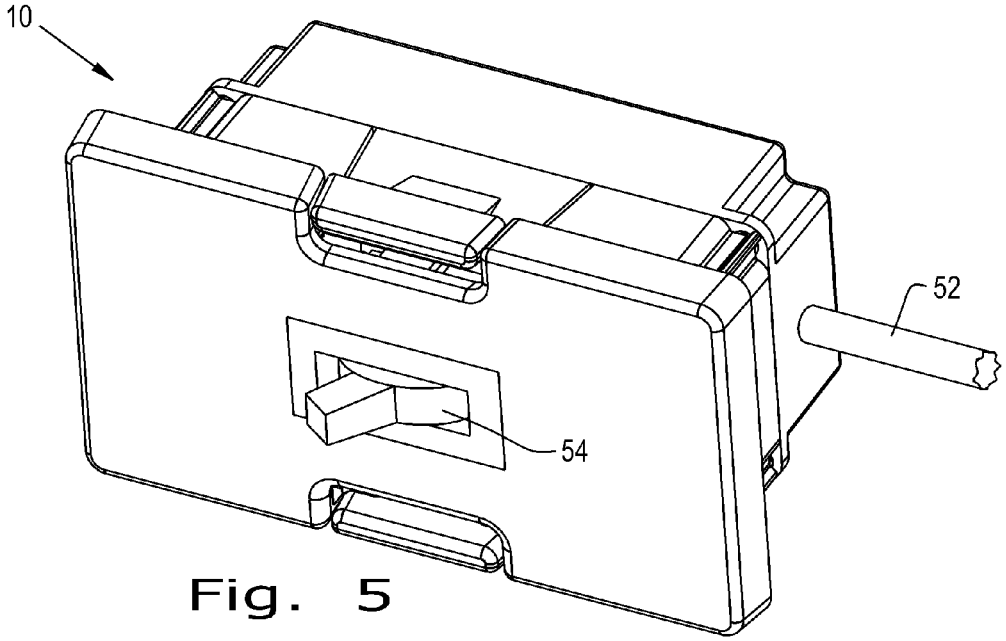
FIG. 5 is a front perspective view of an alternate embodiment of a snap-in electrical receptacle assembly of the present invention.
Figure 6:
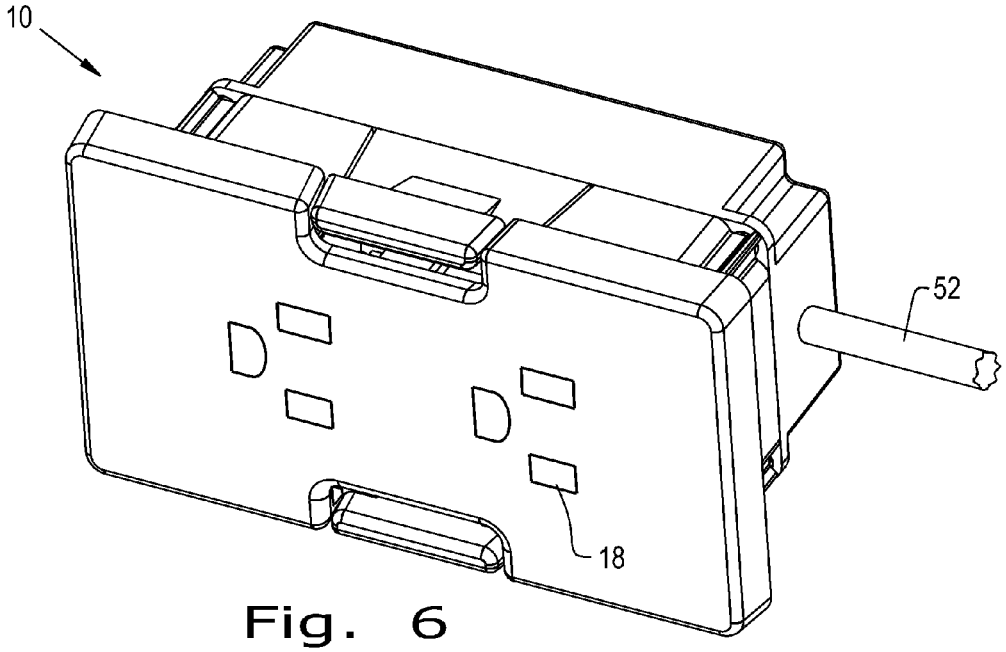
FIG. 6 is a front perspective view of another alternate embodiment of a snap-in electrical receptacle assembly of the present invention.

Now referring to FIGS. 5-6, alternate embodiments of snap-in electrical receptacle assembly 10 are shown.

In both FIGS. 5 and 6, embodiments are shown wherein housing 12 further includes an attached cord or wire that is instead of or in addition to the at least one electrical input port 36. In FIG. 5, an alternate embodiment is shown wherein a switch 54 is shown instead of the electrical outlet 18. FIG. 6 shows another alternate embodiment, wherein an AC outlet is shown as the electrical outlet 18, as described above. It is to be understood that embodiments of the invention may include any combination of switch 54 and/or electrical outlet 18.

While snap-in electrical receptacles have been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A snap-in electrical receptacle, comprising:

a housing including a plurality of sides;

a face plate attached to the housing and including a front surface, a back surface, and at least one notch;

at least one electrical outlet attached to the face plate; and at least one L-shaped member included in at least one of the plurality of sides, the L-shaped member including a shelf generally coplanar with the face plate and an inclined protrusion, wherein the shelf is disposed within said at least one notch of the face plate and includes a top surface that is flush with the front surface of the face plate and a bottom surface that is flush with the back surface of the face plate.

2. The snap-in electrical receptacle of claim 1, wherein the housing further includes a back, a front opening, and a bisecting plane perpendicular to the back and front opening.

3. The snap-in electrical receptacle of claim 2, wherein the snap-in electrical receptacle further comprises at least one electrical input port attached to at least one of the back and one of the plurality of sides.

4. The snap-in electrical receptacle of claim 1, wherein the shelf further includes a slot countersunk in or passing entirely through the shelf.

5. The snap-in electrical receptacle of claim 2, wherein the at least one L-shaped member is capable of allowing the shelf and the inclined protrusion to move inwardly toward the bisecting plane of the housing.

6. The snap-in electrical receptacle of claim 1, wherein the snap-in electrical receptacle is removable from an opening of a supporting surface.

7. The snap-in electrical receptacle of claim 1, wherein the face plate further includes at least one of a width and a length larger than a corresponding at least one of a length and width of the housing.

8. The snap-in electrical receptacle of claim 1, wherein the at least one electrical outlet is a Universal Serial Bus (USB) port.

9. The snap-in electrical receptacle of claim 3, wherein the electrical input port is capable of mating with a two-wire cord.

10. The snap-in electrical receptacle of claim 3, wherein the electrical input port is capable of mating with a three-wire cord.

11. The snap-in electrical receptacle of claim 1, wherein the face plate is removably attached to the housing.

12. A method of installing an electrical receptacle on a supporting surface, comprising:

providing a snap-in electrical receptacle including:

a snap-in electrical receptacle including:

a housing including a back and a plurality of sides;

a face plate attached to the housing and including a front surface, a back surface, and at least one notch;

at least one electrical outlet attached to the face plate; and at least one L-shaped member included in at least one of the plurality of sides, the L-shaped member including a shelf generally coplanar with the face plate and an inclined protrusion, said shelf is disposed within said at least one notch of the face plate and includes a top surface that is flush with the front surface of the face plate and a bottom surface that is flush with the back surface of the face plate;

inserting the back of the housing of the snap-in receptacle into an opening in the supporting surface; and continuing to insert the snap-in electrical receptacle until at least one of the inclined protrusion displaces to a position proximate a back face of the supporting surface and the back surface of the faceplate is proximate a front face of the supporting surface.

13. A method of removing an electrical receptacle from an opening of a surface, comprising:

providing a snap-in electrical receptacle including:

a snap-in electrical receptacle including:

a housing including a back, a front opening, a plurality of sides, and a bisecting plane perpendicular to the back and front opening;

a face plate attached to the housing and including a front surface, a back surface, and at least one notch;

at least one electrical outlet attached to the face plate; and at least one L-shaped member included in at least one of the plurality of sides, the L-shaped member including a shelf generally coplanar with the face plate and an inclined protrusion, said shelf is disposed within said at least one notch of the face plate and includes a top surface that is flush with the front surface of the face plate and a bottom surface that is flush with the back surface of the face plate;

displacing the shelf and the inclined protrusion toward the bisecting plane of the housing; and pulling the snap-in electrical receptacle from the opening.

14. The method of claim 13, wherein the snap-in electrical receptacle further includes a slot countersunk in or passing entirely through the shelf.

15. The method of claim 14, wherein a tool is inserted into the slot of the shelf before it is displaced.

* * * * *